US008522986B2

(12) United States Patent
Kitchen

(10) Patent No.: US 8,522,986 B2
(45) Date of Patent: Sep. 3, 2013

(54) LOCKING PEGBOARD

(76) Inventor: Michael Kitchen, Virginia Beach, VA (US)

( * ) Notice: Subject to any disclaimer, the term of this patent is extended or adjusted under 35 U.S.C. 154(b) by 450 days.

(21) Appl. No.: 12/769,384

(22) Filed: Apr. 28, 2010

(65) Prior Publication Data

US 2011/0073730 A1 Mar. 31, 2011

Related U.S. Application Data

(60) Provisional application No. 61/246,549, filed on Sep. 29, 2009.

(51) Int. Cl.
*A47B 96/06* (2006.01)
*A47G 29/00* (2006.01)
*E04G 5/06* (2006.01)

(52) U.S. Cl.
USPC ..... 211/59.1; 248/220.31

(58) Field of Classification Search
USPC ..... 211/7, 57.1, 59.1, 106.01; 403/348, 403/350, 360, 245, 252, 254; 248/220.31, 248/220.42; 411/349, 549, 553
See application file for complete search history.

(56) References Cited

U.S. PATENT DOCUMENTS

| | | | | | |
|---|---|---|---|---|---|
| 2,715 | A | | 7/1842 | Fowler | |
| 423,730 | A | * | 3/1890 | Charlton | 248/222.52 |
| 478,025 | A | * | 6/1892 | Schraudner | 248/222.13 |
| 483,841 | A | * | 10/1892 | Goodnow | 248/501 |
| 1,202,503 | A | | 10/1916 | Fortier | |
| 1,637,047 | A | | 7/1927 | Moore | |
| 1,846,412 | A | * | 2/1932 | Weinberg | 273/129 R |
| 2,260,048 | A | * | 10/1941 | Newell | 411/552 |
| 3,179,367 | A | * | 4/1965 | Rapata | 248/239 |
| 3,185,427 | A | * | 5/1965 | Peras | 248/309.1 |
| 3,191,777 | A | * | 6/1965 | Willits, Jr. | 211/106.01 |
| 3,216,584 | A | * | 11/1965 | Sedo | 248/220.41 |
| 3,255,987 | A | | 6/1966 | Gatch | |
| 3,310,271 | A | * | 3/1967 | King | 248/220.43 |
| 3,322,287 | A | * | 5/1967 | Ragir | 211/87.01 |
| 3,407,454 | A | * | 10/1968 | Myatt | 411/549 |
| 3,443,783 | A | * | 5/1969 | Fisher | 248/239 |
| 3,688,635 | A | * | 9/1972 | Fegen | 174/138 A |
| 3,724,792 | A | * | 4/1973 | Thalenfeld | 248/220.41 |
| 3,800,369 | A | * | 4/1974 | Nikolits et al. | 24/590.1 |
| 3,880,390 | A | * | 4/1975 | Niven | 248/220.43 |
| 4,223,861 | A | * | 9/1980 | Guggemos et al. | 248/222.52 |
| 4,264,013 | A | * | 4/1981 | Vollmer | 211/85.2 |
| 4,372,450 | A | * | 2/1983 | Licari et al. | 211/106.01 |
| 4,493,580 | A | * | 1/1985 | Ruehl | 403/252 |
| 4,527,760 | A | | 7/1985 | Salacuse | |
| 4,805,784 | A | | 2/1989 | Solheim | |

(Continued)

FOREIGN PATENT DOCUMENTS

WO WO/2004/026084 4/2004

*Primary Examiner* — Darnell Jayne
*Assistant Examiner* — Kimberley S Wright
(74) *Attorney, Agent, or Firm* — Lawrence Lambelet

(57) ABSTRACT

The present invention provides a pegboard-type organization system for articles to be displayed or secured in-place. The pegs can be locked onto the board to support either a weight placed thereon or a side-ways pressure applied thereto. The support can be either rigid or elastic, depending on whether gripping or load-bearing functionality is required. The inventive system allows a board to be flush-mounted to a support surface, and thereby avoids the wasted space conventionally taken up with such substructures as fir strips.

17 Claims, 5 Drawing Sheets

(56) References Cited

U.S. PATENT DOCUMENTS

| | | | | | |
|---|---|---|---|---|---|
| 4,884,688 | A * | 12/1989 | Hurst | 206/362.2 |
| D355,112 | S * | 2/1995 | Richeson | D8/367 |
| 5,927,517 | A * | 7/1999 | Lipman et al. | 211/59.1 |
| 6,481,584 | B1 * | 11/2002 | Cantley | 211/87.01 |
| 6,896,228 | B1 * | 5/2005 | Lu | 248/205.8 |
| 7,051,984 | B2 * | 5/2006 | Botkin | 248/220.31 |
| 7,357,669 | B2 * | 4/2008 | Gabet | 439/549 |
| 2006/0124812 | A1 | 6/2006 | Berardi | |
| 2006/0243687 | A1 * | 11/2006 | Hilger et al. | 211/70.6 |
| 2007/0015403 | A1 * | 1/2007 | Gabet | 439/542 |

* cited by examiner

LOCKING PEGBOARD

CROSS-REFERENCE TO RELATED APPLICATIONS

This non-provisional patent application claims priority to U.S. Provisional Application No. 61/246,549, filed Sep. 29, 2009, which is incorporated herein by reference in entirety.

FIELD OF THE INVENTION

This invention relates to organizers for objects, and more particularly to pegboard displays for tools and the like.

BACKGROUND OF THE INVENTION

A commonly used pegboard is one made of fiberboard which has small round holes for receiving various wire hanger configurations. Because the fiberboard is a relatively soft material, particularly when damp, the small round holes can become damaged or gored out. Alternatively, they can become filled in, as when clogged with paint. When several boards are joined to form an extended layout, the holes frequently loose register at seams. The appearance of the fiberboard pegboard, generally speaking, suffers from a lack of pleasing uniformity. Furthermore, a backing structure is required, such as fir strips on a wall, both to stiffen the board and to provide space behind for insertion of the wire hangers.

The wire hangers must have a lower appendage to provide a brace, or a buttressing support. When the hanger is hooked into its selected hole(s) and rotated to engage therein, the appendage is caused to rest against the pegboard to form a bracket. It can support the weight of an article hanging vertically, but a force from any other direction would tend to disengage it. Consequently, the pegboard must be used in a wall mount, or otherwise be supported vertically on a base. It cannot serve to fixture a layout of articles in a horizontal attitude, for example. The dangling appendage, furthermore, makes close spacing difficult for small articles or dense layouts.

The prior art addresses some of these disadvantages with an improved hanger, or peg. U.S. Pat. No. 4,805,784 to Solheim, for example, discloses a mounting device for a slat wall. A slat wall has rows of channels, rather than holes, which gives a more regular appearance and some flexibility with location in the channel direction. The channels, in this version of a slat wall, have a T-shaped cross section. The device has a transverse crossbar at the end of the peg which can be aligned with the throat of the channel and then rotated by a twisting motion to a position of engagement. The bilateral extension of the "T" resists forces bearing on the peg in the two directions parallel to the crossbar, but is relatively ineffective for directions approaching the perpendicular. To support a weight, the slat wall must be vertical, the channels must be horizontal, and the blind rotation must approximate a quarter turn.

U.S. Pat. No. 3,255,987 to Gatch uses a similar technique with a crossbar. The crossbar, in this instance, flexes to provide a compression hold on the interfacing surface. Similar to Solheim, the fixture generates support in only two primary directions and lacks a means for registering an optimal rotation angle for the crossbar. The board has an array of slots instead of channels or small round holes. This layout affords more flexibility with inter-peg spacing than either with the proscribed channels or the cumbersome hangers. Unlike the previous reference, the board can be of uniform thickness; but it, nonetheless, requires standoff from a support surface to allow for insertion of the peg.

WIPO Publication WO 2004/026084 to McCormack discloses a ball and socket interface, wherein the peg terminates in a ball and the board is comprised of an array of sockets. The peg, however, is connected by a hook at the end of the ball which is inserted into a hole at the apex of the socket. Similar to the hanger scenario, the connection provides little support in any direction from which it might be unhinged, irrespective of the omni-directional geometry. Like other prior art, the board must be used in a vertical attitude, and space must be provided behind it for insertion of the peg.

The prior art is silent with respect to a capability for firmly gripping an article in any posture of a display board and in any orientation of the article to a peg, and wherein additional capabilities, such as close spacing for articles and flush-mounting of the board to a surface, are included.

SUMMARY OF THE INVENTION

It is accordingly an object of the present invention to provide a means for organizing articles in a customizable layout.

It is further object of the present invention to secure the articles in a layout for purposes of display or transport.

It is a further object of the present invention to configure a preferred layout by locating pegs in an array of apertures on a board.

It is a further object of the present invention to lock the pegs in place to prevent unintended dislocation.

It is a further object of the present invention for a mounted peg to resist applied tension from any direction.

It is a further object of the present invention to use mating convex and concave geometries to provide a base of support for the peg.

It is further object of the present invention for the board to be placed in any orientation, whether vertical, horizontal, or in between, without losing retention of the articles thereon.

It is a further object of the present invention to eliminate any need for a gap between the board and a surface on which it is placed or mounted.

It is further object of the present invention to provide a means to hold an article in a tension grip.

It is a further object of the present invention to allow close spacing of the pegs.

These objects, and others to become hereinafter apparent, are embodied in a flush-mount attachment system for an array of articles, comprising an essentially flat board having a front side and a back side. The front side has a pattern of convex blisters thereon. Each blister has a circular cross-section, an inside surface, a blister recess defined by said inside surface, and a key-slot aperture into said recess. The attachment system further comprises at least one peg having a proximal end and a distal end. The proximal end has a means for releasably engaging a selected blister by insertion into the blister recess through the key slot aperture. The distal end has a means for engaging an article. The attachment system further comprises a means for bracing the at least one peg against the weight, or otherwise pressure, of an article placed against or attached to said peg. Finally, the attachment system comprises a means for reversibly locking the at least one peg to the selected blister. A preferred layout of pegs is configurable in this system from the front side of the essentially flat board with the back side flush to a support surface In the preferred embodiment, the key slot aperture is longitudinal in aspect and positioned centrally on the blister. The means for releasably engaging comprises a T-shaped key. The T-shaped key has a longitudinal crossbar at the end of a shank. The shank is rotatable within the key slot aperture. The crossbar is rotatable within the blister recess to engage the inside surface at a preferred position. The preferred position is at approximately 90 degrees of rotation.

In another aspect of the preferred embodiment, the means for bracing comprises a flared skirt on the peg. The flared skirt has a concave skirt recess complementary to the convex blister. The flared skirt encloses the blister while permitting the peg to stand against the flat board for a broad-based buttress-like support in the round In a particularly preferred embodiment, wherein the blister is rendered resiliently flexible, the attachment system further comprises a means for laterally gripping an article. The means for laterally gripping an article comprises a two-part peg assembly in which the flared skirt as a separate component can be reassembled onto the peg in reverse to present a narrow end to the blister. The narrow end bears against a partial surface of the blister which can deform in response to a lateral force against the peg. The deformation causes the blister to react with a tension force In an alternate embodiment, a method of attaching an article to an intimate support surface, for display or transport purposes, comprises the steps of providing the flush-mount system as described above; providing a plurality of pegs, wherein the means for engaging an article is a terminal feature in the shape of a ball; attaching the essentially flat board to the support surface; determining a first array of locations on the article sufficient for vertical support thereto, as appropriate; determining a second array of locations on the article sufficient for lateral support thereto, as appropriate; making a first selection of the blisters of the pattern in best correspondence to the first array; locking pegs in place to the first selection with the wide end of the flared skirt assembled to contact the blister; making a second selection of the blisters of the pattern in best correspondence to the second array; locking pegs in place to the second selection with the narrow end of the flared skirt assembled to contact the blister; and mounting the article to the resulting layout of pegs, the resilient force of the blisters and the engagement of the balls retaining the article to the essentially flat board.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
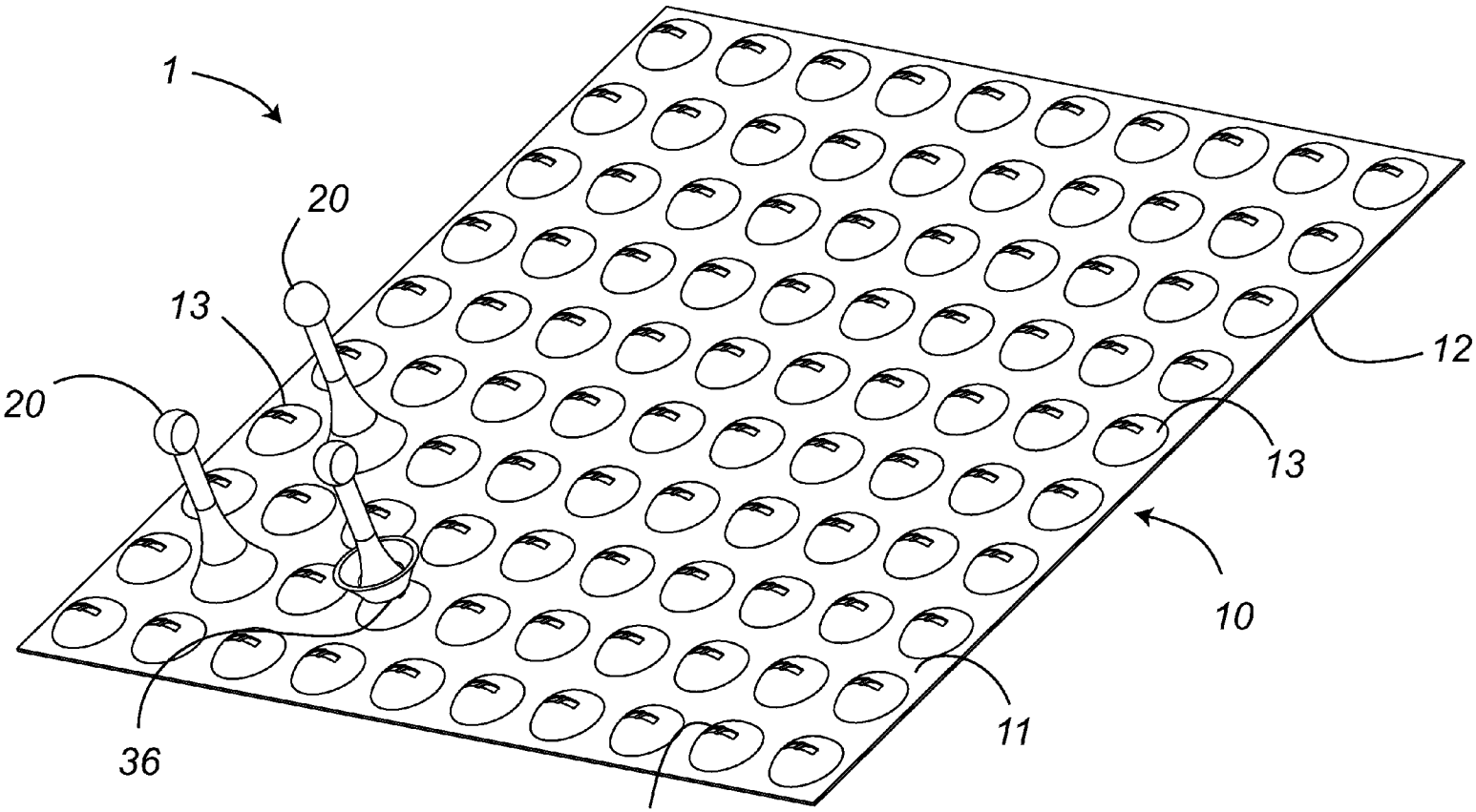
FIG. 1 is a perspective view of the flush-mount attachment system of the present invention showing a three peg array.

FIG. 1 shows the principal components of a flush-mount attachment system 1. The flush-mount attachment system 1 is comprised of a board 10 to which pegs 20 can be attached to hold an article 2 (not shown) there between. The board 10 is comprised of an array of convex blisters 13. The array is comprised of such regularity and spacing as to allow a customized layout of pegs 20 to firmly and securely grip an article, the article having a relatively larger size than the spacing. The board and peg system permit the article to be mounted on a wall, for example, to display the article. Alternatively, the board and peg system can fixture the article in-place for storage or transport purposes. As will be explained hereinafter, novel features of the invention eliminate the dependence on gravity to hold the article in place.

Figure 2:
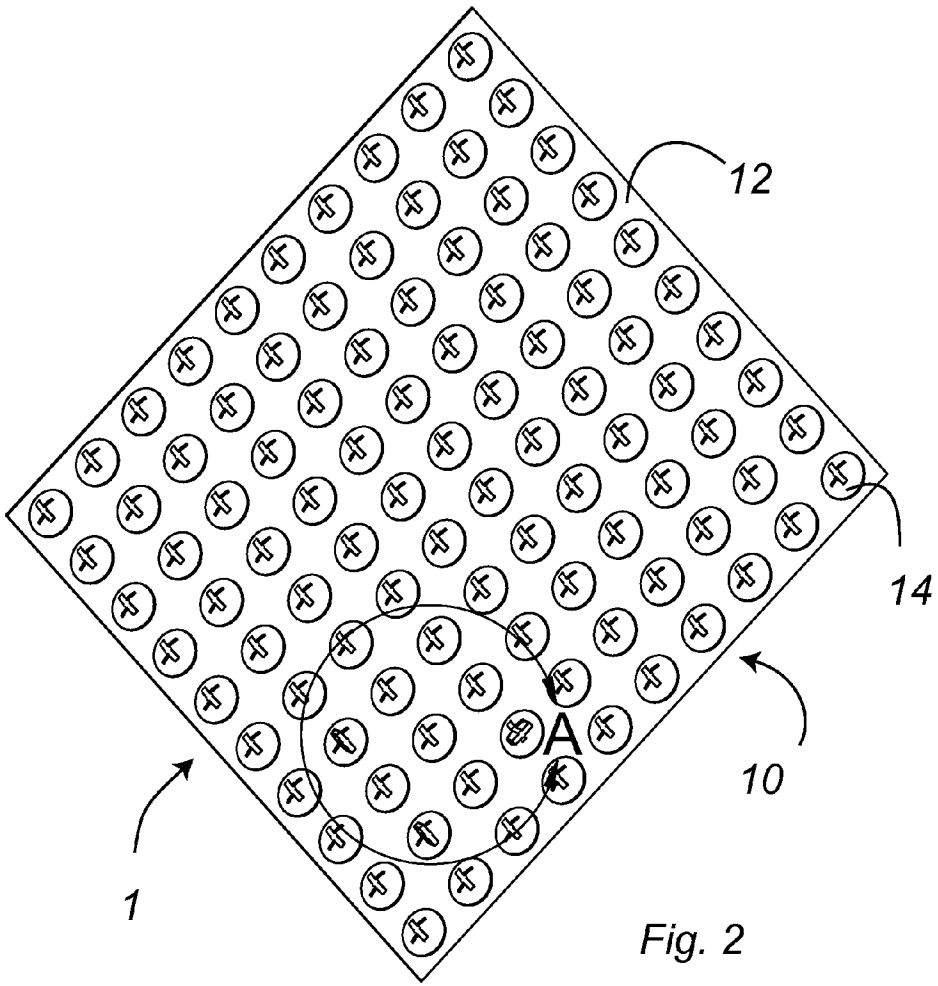
FIG. 2 is a perspective view of the back of the board showing the T-shaped key inside the cavity.

As shown in FIGS. 1 and 2, the convex blister 13 stands in relief from a front side 11 of the board 10. This permits a back side 12 (FIG. 2) to be essentially flat and capable of being placed flush to any support surface. The blister 13 is comprised of an inside surface 14 which defines a blister recess 15. The blister 13 and the blister recess 15 are essentially circular in cross-section. The blister recess 15 is accessible from the front side 11 by means of a key-slot aperture 16. The key-slot aperture 16 has a longitudinal configuration and is placed centrally on the crown of the blister. In the preferred embodiment, the blisters 13 are arrayed regularly in rows and columns.

Figure 6:
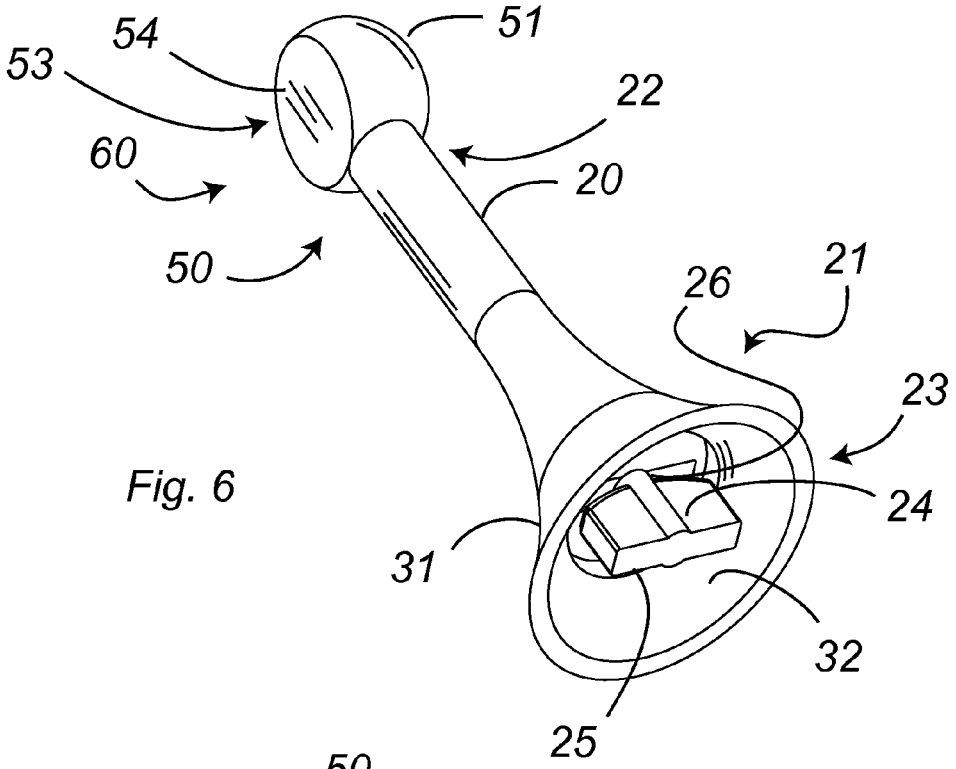
FIG. 6 is a perspective view of the peg.
Figure 8:
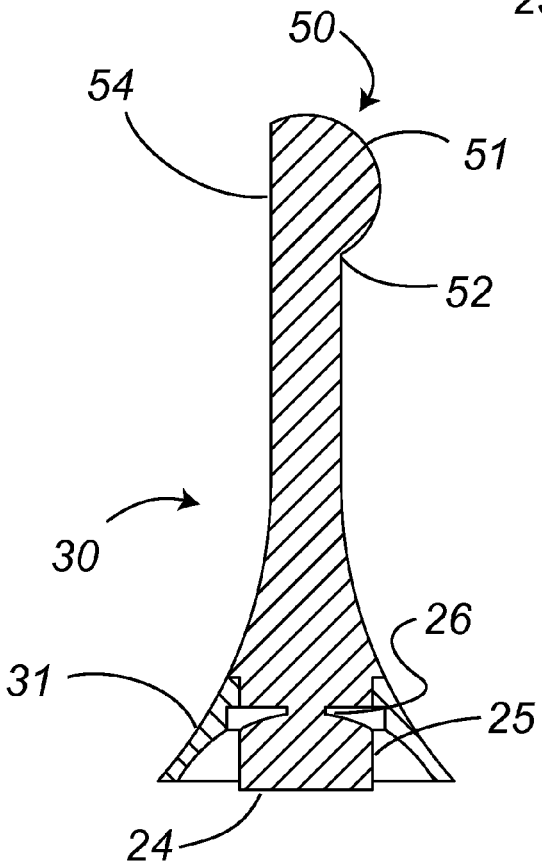
FIG. 8 is a section view of the peg taken along line 8-8 of FIG. 7.
Figure 7:
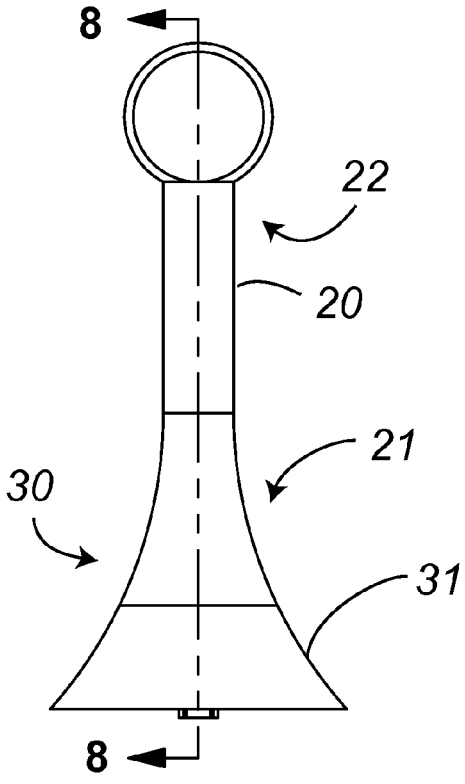
FIG. 7 is an elevation view of the peg.
Figure 9:
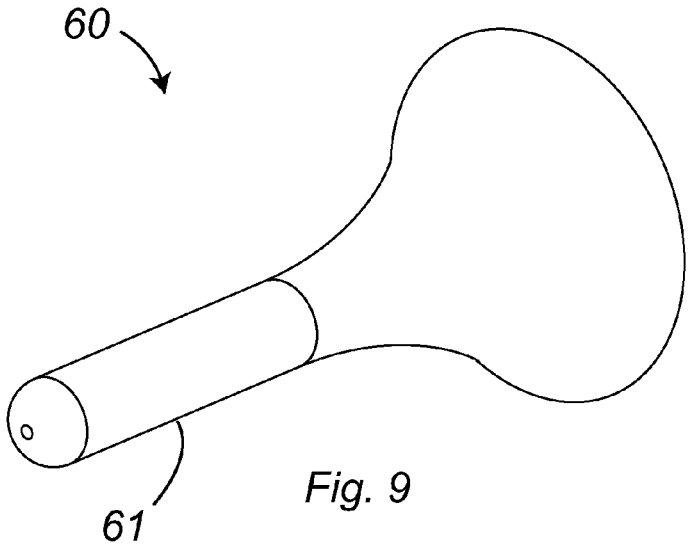
FIG. 9 is a perspective view of straight end terminal feature.
Figure 10:
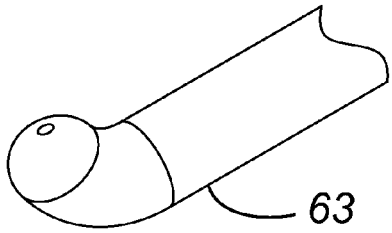
FIG. 10 is a partial perspective view of an upwardly-bent terminal feature.
Figure 11:
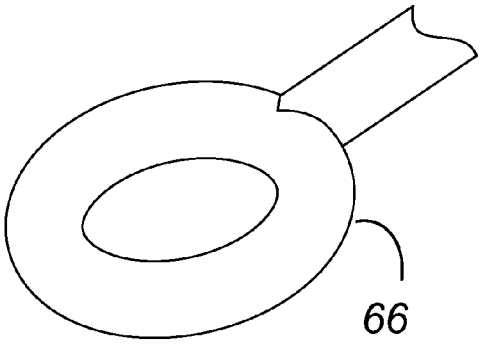
FIG. 11 is a partial perspective view of a loop terminal feature.
Figure 12:
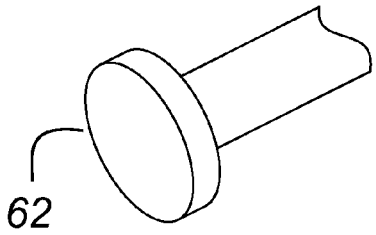
FIG. 12 is a partial perspective view of disk terminal feature.
Figure 13:
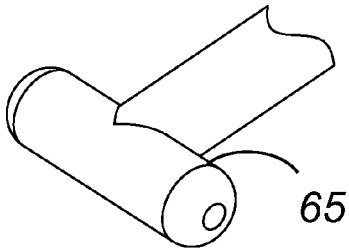
FIG. 13 is a partial perspective view of a T-bar terminal feature.
Figure 14:
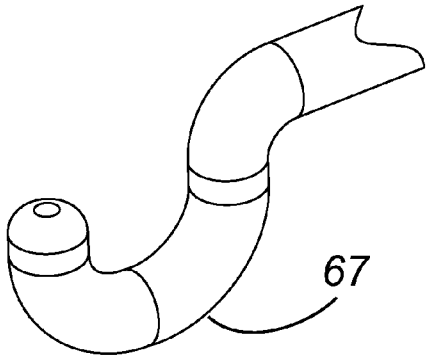
FIG. 14 is a partial perspective view of a hook terminal feature.

Referring to FIGS. 6-8, the peg 20 is comprised of a proximal end 21 and a distal end 22. The proximal end 21 is comprised of a means for releasably engaging 23. The means for releasably engaging 23 is comprised of a T-shaped key 24, which is inserted into the key-slot aperture 16 of the blister 13 to engage therein by means of a rotational twist. The T-shaped key 24 is comprised of a crossbar 25 at the end of a shank 26. The crossbar 25 has a profile that allows passage through the key-slot aperture 16. The crossbar 25 further has a longitudinal extent, such that misalignment of said crossbar with the longitudinal aspect of the key-slot aperture 16 places said crossbar in an interference position with the inside surface 14 of the blister 13. The shank 26 is rotatable within the key-slot aperture 16. The shank 26 extends sufficiently into the blister 13, when the peg 20 is seated thereon, to place the crossbar 25 in brushing contact with the inside surface 14.

The distal end 22 of the peg 20 is comprised of a means for engaging an article 50. In the preferred embodiment, the means for engaging an article 50 is a terminal feature 60 in the configuration of a ball 51. The ball 51 has sufficient girth as to define a ledge 52 at the junction of the ball 51 and the distal end 22. The ledge 52 is useful for retaining the article 2 on the peg 20. Some of the alternate embodiments of the terminal feature 60 are shown in FIGS. 9-14. Terminal features 60 additionally comprise a straight end 61, a disk end 62, an upwardly-bent end 63, a flattened end 64 (not shown), a T-bar end 65, a loop end 66, a hook end 67 and a slotted end 68 (not shown).

When the peg 20 is seated on a selected blister 13, a means for bracing 30 is engaged coincident with the means for releasably engaging 23. The means for bracing 30 comprises a flared skirt 31, in which a concave skirt recess 32, in complementary configuration to the convex blister 13, rests against or over said blister. In this position, the flared skirt 31 bears against the front side 11 of the board 10 to form a buttress-like support for the peg 20. Since the flared skirt 31 has a complementary circular cross-section, the buttress-like support acts in all directions. The broader the flare of the skirt, and the larger the cross-section, the greater the holding power thereby provided. The trade-off, however, is with the spacing of the pegs 20; or, in other words, the granularity of the peg spacing with respect to the dimensions of the article. In the preferred embodiment, the pegs 20 are spaced at intervals of 0.5 to 1.0 inches and individually hold between 30 and 60 pounds.

Figure 3:
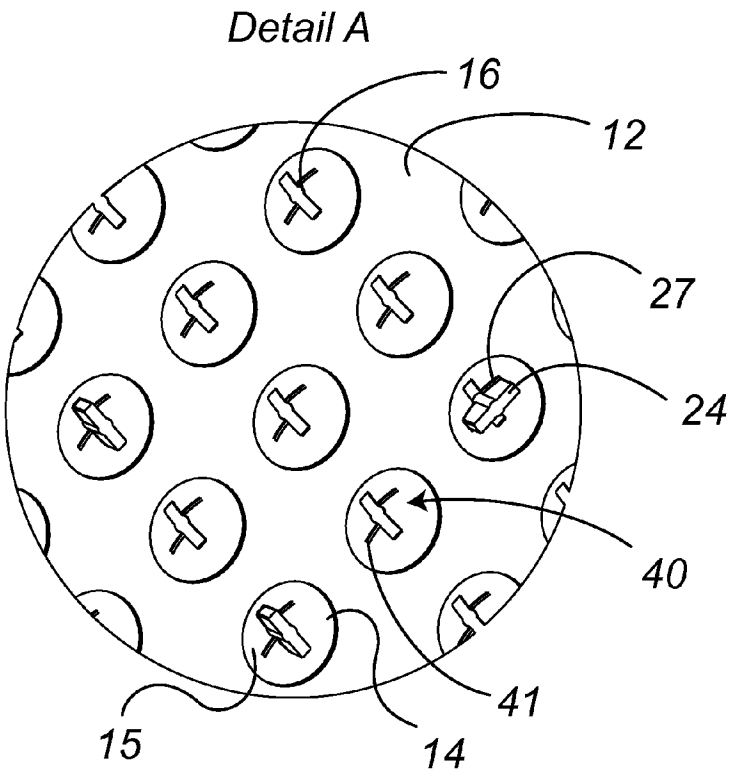
FIG. 3 shows Detail A of FIG. 2, wherein the T-shaped key is shown in locked and unlocked positions.

When the T-shaped key 24 is inserted in the key-slot aperture 16 of a selected blister 13, the peg 20 is rotated to a preferred position 27 (FIG. 3) where structural interference prevents it from being withdrawn there from. In the preferred embodiment, the preferred position 27 is at a rotational angle of approximately 90 degrees. At that location, a means for reversibly locking 40 inhibits further rotational movement and prevents slippage of position. The means for reversibly locking 40 is comprised of a pair of bosses 41 positioned to straddle the T-shaped key 24. When the blister 13 is rendered resiliently flexible, a slight compression force on the blister crown frees the rotation of the T-shaped key 24 to the preferred position 27 and into abutment against the pair of bosses 41. The resilient recovery thereafter pins the T-shaped key into location and between the bosses 41. In the preferred embodiment, the two bosses are arrayed oppositely, but they may also be arrayed in tandem to box-in the T-shaped key.

Figure 5:
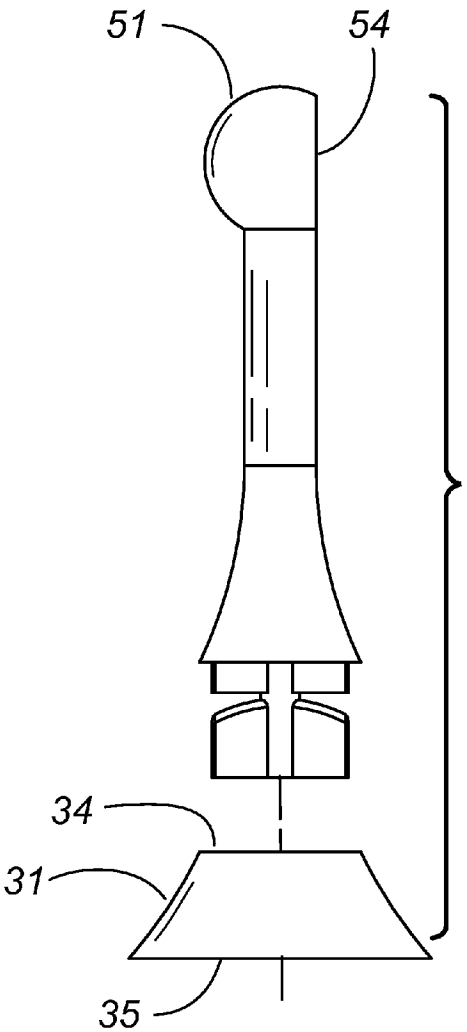
FIG. 5 is an exploded view of the peg assembly.
Figure 4:
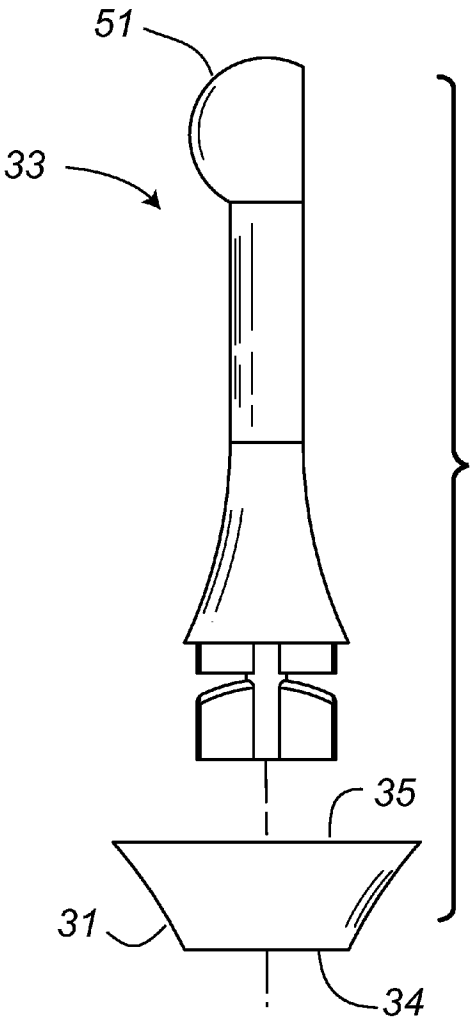
FIG. 4 is an exploded view of the peg assembly with the skirt reversed.

The locked-in peg 20, with the means for bracing 30 engaged, presents a rigid support for the article 2 placed against it in any orientation from the vertical to the horizontal. It is sometimes useful, however, to provide a gripping action, as when an article is placed between two pegs with gravity acting to cause slippage there through. A novel feature of the present invention provides a means for laterally gripping 33. The means for laterally gripping 33 is comprised of a two-component peg 20, wherein the flared skirt 31 can be removed and reassembled with an end-to-end reversal, as shown in FIGS. 4 and 5. Because of the flare, one end of the flared skirt 31 is narrower than the other. When the reassembled peg 20 is seated, a narrow end 34 is placed against a partial surface 36 (FIG. 1) of the blister 13. When sideways pressure is applied to peg 20, the partial surface 36 deforms the resiliently flexible blister 13 causing a tension response. Two pegs placed horizontally, and configured as above, would suspend an article placed there between when the spacing is such as to bias the pegs apart.

A wide end 35 of the skirt 31, at the same time, provides a stand-off from the blister 13 and causes the sideways pressure to be applied at a point distant from the T-shaped key. Because the T-shaped key operates as a fulcrum in this circumstance, the stand-off results in a mechanical leverage being applied to the peg 13. The wide end 35 additionally functions to space the article 2 away from the board 10.

In circumstances where the blister 13 and/or the flared skirt 31 are/is opaque, and therefore inter-positioning is blind, it is useful to provide a means for orienting the peg 20 to the preferred, and locked, position 27. In the preferred embodiment, a means for orienting 53 is comprised of a flat surface 54 on the ball 51 (FIG. 6). The flat surface 54 preferably has a surface normal in alignment with the longitudinal direction of the T-shaped key 24. The flat surface 54 can be any of the lesser cross-sections of ball 51, but that cross-section in tangency with the peg is one preferred. The flat surface 54 additionally provides a means for grasping the peg 20 and applying a twisting motion thereto. The preferred cross-section maximizes that grasp and twist leverage.

The board 10 and the peg 20 are preferably fabricated by molding technologies where precision tolerances can be met. The peg 20 is preferably injection-molded. The board 10 can be injection-molded or thermoformed from sheet or roll film stock. The key material properties are toughness and strength. Since flexibility is often at odds with strength, the flexibility of the blister is best served by thinning-out the wall. The property of toughness, wherein plastic deformation is sustainable, provides the requisite resiliency in combination with the architectural strength of the convex shape of the blister. Among the polymer materials having the preferred properties are high-impact polystyrene (HIPS), acrylonitrile butadiene styrene (ABS), polypropylene (PP), high-density polyethylene (HDPE), poly-vinyl chloride (PVC), and polyolefin (PP and PE).

As shown in the discussion above, a plurality of articles can be placed in any organization on the flush-mount attachment system 1 and held securely thereon for any orientation of said system relative to gravity. In engineering a secure placement, an analysis of where dislodging forces might be brought to bear on any particular article for any particular scenario would lead to a selection of sites for locating the pegs and to a choice between gripping or load-bearing functionality. In an alternative embodiment of the present invention, a method of attaching an article to an intimate support surface comprises the following steps:

(a.) Providing the flush-mount system 1, as described above;

(b.) Providing a plurality of pegs 20, wherein the means for engaging an article 50 is a terminal feature in the shape of a ball 51;

(c.) Attaching the essentially flat board 10 to the support surface;

(d.) Determining a first array of locations on the article 2 sufficient for vertical support thereto, as appropriate;

(e.) Determining a second array of locations on the article 2 sufficient for lateral support thereto, as appropriate;

(f.) Making a first selection of the blisters 13 in best correspondence to the first array;

(g.) Locking pegs 20 into place to the first selection with the wide end 35 of the flared skirt 31 assembled to contact the blister 13;

(h.) Making a second selection of the blisters 13 in best correspondence to the second array;

(i.) Locking pegs 20 into place to the second selection with the narrow end 34 of the flared skirt 31 assembled to contact the blister 13; and (j.) Mounting the article 2 to the resulting layout of pegs 20, the resilient force of the blisters 13 and the engagement of the balls 51 retaining the article 2 to the essentially flat board 10.

It is to be understood that the invention is not limited in its application to the details of construction and to the arrangements of the components set forth in the preceding description or illustrated in the drawings. For example, a travel chess set might be comprised by arraying the blisters in correspondence to spaces on a chess board and configuring a chess-piece-complement of pegs with terminal features representing the individual chess pieces. Also, it is to be understood that the phraseology and terminology employed herein are for the purpose of the description and should not be regarded as limiting.

What is claimed is:

1. A flush-mount attachment system for an array of articles, comprising:

an essentially flat board having a front side and a back side, the front side having a pattern of convex blisters thereon, each blister having orthogonally circular cross-sections, an inside surface, a blister recess defined by said inside surface, and a key-slot aperture into said blister recess;

at least one peg having a proximal end and a distal end, the proximal end having a means for releasably engaging a selected blister by insertion into the blister recess through the key slot aperture, the distal end having a means for engaging an article;

a flared skirt on the at least one peg, the flared skirt having a concave skirt recess complementary to the convex blister, the flared skirt enclosing the blister while permitting the peg to stand against the flat board for broad-based buttress-like support in the round; and a means for reversibly locking the at least one peg to the selected blister;

whereby a preferred layout of pegs is configurable from the front side of the essentially flat board with the back side flush to a support surface, each peg being braced against the weight of, or otherwise pressure from, an article placed against, or attached to, said peg.

2. The attachment system of claim 1, wherein the key slot aperture is longitudinal in aspect and positioned centrally on the blister.

3. The attachment system of claim 2, wherein the means for releasably engaging comprises a T-shaped key, the T-shaped key having a longitudinal crossbar at the end of a shank, the shank rotatable within the key slot aperture, the crossbar rotatable within the blister recess to engage the inside surface at a preferred position, the preferred position at approximately 90 degrees of rotation.

4. The attachment system of claim 3, wherein the blister is resiliently flexible.

5. The attachment system of claim 4, wherein the means for reversibly locking comprises a pair of bosses on the inside surface of the blister, the bosses placed to straddle the T-shaped key at the preferred position, the flexibility of the blister enabling registration of the T-shaped key to the bosses, the resiliency of the blister pinning said T-shaped key to the inside surface in said registration.

6. The attachment system of claim 1, wherein the means for engaging an article is a terminal feature in the shape of a ball, the ball providing a ledge by means of its bulbous extension.

7. The attachment system of claim 6, wherein the means for engaging an article further comprises a means for orienting the peg.

8. The attachment system of claim 7, wherein the means for orienting the peg comprises a flat surface on the ball, the surface normal corresponding to the longitudinal direction of the crossbar of the T-shaped key.

9. The attachment system of claim 1, wherein the means for engaging an article comprises terminal features selected from the group consisting of a straight end, a disk end, an upwardly-bent end, a flattened end, a crossbar end, a loop end, a hook end and a slotted end.

10. The attachment system of claim 1, further comprising a means for laterally gripping an article.

11. The attachment system of claim 10, wherein the means for laterally gripping an article comprises a two-part peg assembly in which the flared skirt as a separate component can be reassembled onto the peg in reverse to present a narrow end to the blister, the blister being resiliently flexible, the narrow end bearing on a partial surface of the blister, the partial surface deforming in response to a lateral force against the peg, the blister reacting there against with a tension force.

12. A method of attaching an article to an intimate support surface, for display or transport purposes, comprising the steps of:

providing the flush-mount system of claim 11;

providing a plurality of pegs, wherein the means for engaging an article is a terminal feature in the shape of a ball;

attaching the essentially flat board to the support surface;

determining a first array of locations on the article sufficient for vertical support thereto, as appropriate;

determining a second array of locations on the article sufficient for lateral support thereto, as appropriate;

making a first selection of the blisters of the pattern in best correspondence to the first array;

locking pegs into place to the first selection with the wide end of the flared portion assembled to contact the blister;

making a second selection of the blisters of the pattern in best correspondence to the second array;

locking pegs into place to the second selection with the narrow end of the flared portion assembled to contact the blister; and mounting the article to the resulting layout of pegs, the resilient force of the blisters and the engagement of the balls retaining the article to the essentially flat board.

13. The method of claim 12, wherein the means for reversibly locking comprises a pair of bosses on the inside surface of the blister, the bosses placed to straddle the T-shaped key at the preferred position, the flexibility of the blister enabling registration of the T-shaped key to the bosses, the resiliency of the blister pinning said T-shaped key to the inside surface in said registration.

14. The attachment system of claim 1, wherein the essentially flat panel and the at least one peg are molded components.

15. The attachment system of claim 14, wherein the molded components are comprised of polymer materials having the properties, at least, of toughness and strength.

16. The attachment system of claim 15, wherein the polymer material is a least one of high-impact polystyrene (HIPS), acrylonitrile butadiene styrene (ABS), polypropylene (PP), high-density polyethylene (HDPE), poly-vinyl chloride (PVC, or polyolefin (PP and PE).

17. The attachment system of claim 1, wherein the blister wall thickness is thinned out from that of the surrounding board, the blister thereby receiving greater flexibility.

* * * * *